United States Patent [19]

Rutkowski

[11] 4,156,990

[45] Jun. 5, 1979

[54] GAUGING ATTACHMENT FOR A ROTARY CUTTING TOOL

[75] Inventor: Edward Rutkowski, Chicago, Ill.

[73] Assignee: United States Steel Corporation, Pittsburgh, Pa.

[21] Appl. No.: 878,143

[22] Filed: Feb. 15, 1978

[51] Int. Cl.[2] ..... B24B 23/00

[52] U.S. Cl. ..... 51/170 PT; 144/136 C; 409/180

[58] Field of Search ..... 51/170 PT, 170 R, 241 G, 51/208, 205 WG; 90/12 B; 144/136 C

[56] References Cited

U.S. PATENT DOCUMENTS

| | | | |
|---|---|---|---|
| 2,238,304 | 4/1941 | Belanger | 144/136 C |
| 2,587,994 | 3/1952 | Gregory | 144/136 C |
| 2,748,543 | 6/1956 | Pardee | 51/102 |
| 2,906,067 | 9/1959 | Hale | 51/170 PT |
| 3,478,788 | 11/1969 | Zelik | 144/136 C |
| 4,002,089 | 1/1977 | Granberg | 51/170 PT |
| 4,019,407 | 4/1977 | Penberthy | 51/170 PT |

*Primary Examiner*—Harold D. Whitehead
*Assistant Examiner*—Roscoe V. Parker
*Attorney, Agent, or Firm*—William F. Riesmeyer, III

[57] ABSTRACT

An attachment is provided for a tool with a rotary cutting element. The attachment enables an operator of the tool to determine when sufficient stock is removed from the wall of a slot to obtain the proper slot width and includes a gauging element extending longitudinally and generally parallel to the rotary cutting element, said gauging element being of width slightly less than the desired slot width. A cutting edge portion of the rotary cutting element protrudes from the plane of one of the elongated surfaces of the gauging element so that stock may be removed from a slot wall while the gauging element trails behind the cutting edge in the slot. In preferred form, a guide is located 180 degrees from the gauging element so as to precede the rotary cutting element into the slot and control the depth of cut thereof along the slot wall.

2 Claims, 3 Drawing Figures

GAUGING ATTACHMENT FOR A ROTARY CUTTING TOOL

BACKGROUND OF THE INVENTION

1. Field of the Invention

Steel piling bars such as those shown in U.S. Pat. No. 2,250,908, commonly have a slot extending along an elongated edge in which the tongue of another piling bar fits to form interlocking sections. The interlocked sections are used for construction purposes. In making piling, the bars are rolled on a structural mill and sometimes are produced with a slot which is of insufficient width. When this situation occurs, it is necessary to widen the slot.

2. Prior Art

In the past, underwidth slots of piling bars were pryed open using a jackhammer having a tapered tool. This practice is quite time consuming and requires considerable manhours and expense. Portable grinders can be used to remove stock from a portion of the wall of the slot but the grinder operator must be careful not to remove too much stock and must constantly stop to gauge the width. It is also difficult to guide the grinder along a straight path manually.

Attachments for portable grinders for various purposes are known. Examples are shown in U.S. Pat. No. 2,238,304, U.S. Pat. No. 4,002,089 and U.S. Pat. No. 4,019,407. However, none of the attachments in the cited patents serve as a sizing gauge for a tool being used to remove stock from the wall of a slot.

SUMMARY OF THE INVENTION

According to this invention, an attachment is provided for mounting on a tool with a rotary cutting element. The attachment includes a gauging element extending in a longitudinal direction generally parallel to the rotary cutting element. The gauging element has a first elongated surface lying in a plane parallel to and spaced exteriorly, with respect to the rotary cutting element, to a first plane tangent to the periphery of said cutting element; and a second elongated surface lying in a plane parallel to and spaced a slight distance interiorly from a second plane tangent to the periphery of the rotary cutting element; the first and second tangent planes being parallel to each other. Transverse surfaces connect the first and second elongated surfaces of the gauging element. A means is provided for attaching the gauging element to the tool housing.

In a preferred form, a guide means has a first elongated surface lying in the plane of the second elongated surface of the gauging element and located so as to precede the rotary cutting element into the slot serving to control the depth of cut made by said element against the slot wall.

It is an object of this invention to provide an attachment for a tool used to remove stock from the wall of a slot, which will enable an operator to determine when the desired slot width is obtained.

This and other objects of the invention will become more apparent from a reading of the following detailed description when taken in conjunction with the appended claims and drawings, in which:

DESCRIPTION OF THE PREFERRED EMBODIMENT

Figure 1:
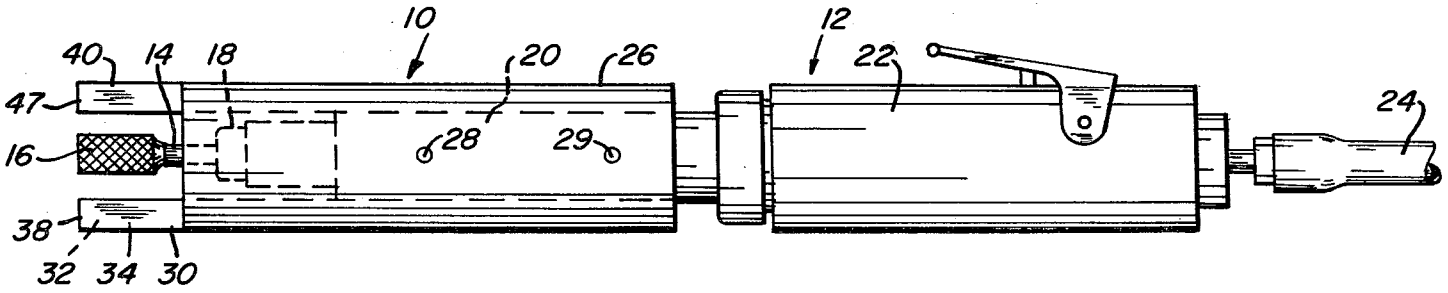
FIG. 1 is a plan view of a tool fitted with the attachment of this invention.

According to this invention, an attachment 10 (FIGS. 1 and 2) is provided for mounting on a tool 12 having a rotary cutting element 14. The tool may be a portable air-powered die grinder such as the Model No. EG 30G4 manufactured by Ingersoll-Rand. The cutting element may be a grinding bit, as shown, with peripheral cutting surface 16 along a portion of its length. The bit is secured in chuck 18 at the end of housing 20, and is rotatively driven by air motor 22 supplied with air from line 24. Means for securing attachment 10 to the tool 12 is provided and may include a sleeve 26 and set screws, 28, 29 engageable in housing 20.

Figure 2:
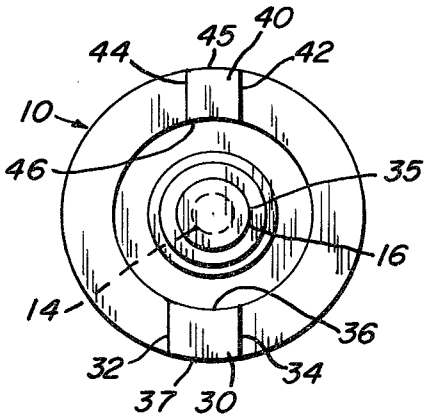
FIG. 2 is an enlarged end view of the apparatus of FIG. 1.

Attachment 10 has a gauging element 30 extending from sleeve 26 in its longitudinal direction generally parallel to and spaced apart from rotary cutting element 14, and preferably is of greater length than rotary cutting element 14 so as to prevent cutting into the bottom of a slot to be ground. A first elongated surface 32 (FIGS. 1 and 2) of gauging element 30 lies in a plane parallel to a first plane tangent to the periphery of rotary cutting element 14 (as best seen in FIG. 2). First elongated surface 32 is spaced exteriorly with respect to the periphery of rotary cutting element 14. A second elongated surface 34 (FIG. 2) of gauging element 30 is spaced from first elongated surface 32 a distance slightly less than the desired width of the slot which is to be widened. A cutting edge 35 of rotary cutting element 14 extends beyond the plane of second elongated surface 34 so as to enable removal of stock from the slot wall. The distance from cutting edge 35 to first elongated surface 32 of gauging element 30 is equal to the desired slot width. The first and second tangent planes above referred to are parallel to each other. Transverse surfaces 36, 37 (FIG. 2) and 38 (FIG. 1) connect first and second elongated surfaces 32, 34.

In a preferred form, a guide means 40 is provided to control the depth of cut made by rotary cutting element 14. Guide means 40 (FIGS. 1 and 2) extends in its longitudinal direction generally parallel to rotary cutting element 14 and is located 180 degrees from the gauging element 30 with respect to rotary cutting element 14. A first elongated surface 42 of guide means 40 lies in the plane through second elongated surface 34 of gauging element 30 so that the periphery of rotary cutting element 14 and a cutting edge 35 thereof extends beyond first elongated surface 42. A second elongated surface 44 of guide means 40 is spaced from the first elongated surface 42 thereof by a distance less than the diameter of rotary cutting element 14. Transverse surfaces 45, 46 and 47 connect the first and second elongated surfaces 42, 44 of guide means 40.

Figure 3:
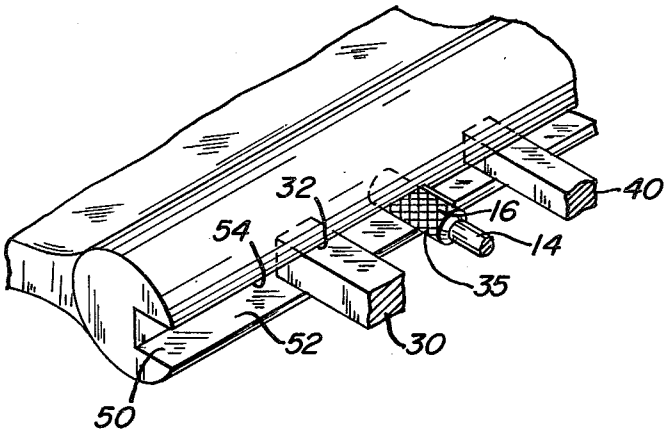
FIG. 3 is an isometric cutaway view showing the apparatus of this invention being used to remove stock from the wall of a slot.

In operation, guide means 40 (FIG. 3) precedes rotary cutting element 14 into an open end 50 of slot 52, controlling the depth of cut of as rotary cutting element 14 travels along the wall of slot 52. Gauging element 30 trails behind cutting edge 35 of rotary cutting element 14 with first elongated surface 32 riding against wall 54 of slot 52 and enables the tool operator to determine when sufficient stock is removed to obtain the desired slot width.

I claim:

1. An attachment for a tool having a housing and a rotary cutting element installed therein, said attachment providing means to indicate when sufficient stock is removed from a slot wall to obtain the desired slot width, and comprising:

a gauging element extending in a longitudinal direction generally parallel to and spaced apart from the rotary cutting element, said gauging element having a first elongated surface parallel to and spaced exteriorly from a first plane tangent to the periphery of the rotary cutting element and a second elongated surface parallel to the first elongated surface and spaced therefrom a distance slightly less than the desired slot width, said second elongated surface being parallel to and spaced a slight distance interiorly from a second plane tangent to the periphery of the rotary cutting element so that a cutting surface thereof extends beyond the plane of the second elongated surface, and said first and second planes tangent to the periphery of the rotary cutting element being parallel to each other, and a means for securing said gauging element to the tool housing such that said gauging element trails behind the rotary cutting element from an open end of a slot along the wall thereof indicating when the desired width is obtained.

2. The apparatus is claim 1 further comprising guide means for mounting on the tool housing, said guide means being located 180 degrees from said gauging element with respect to the rotary cutting element so as to precede said rotary cutting element into the slot, said guide means extending in a longitudinal direction generally parallel to the rotary cutting element, said guide means having a first elongated surface lying in the plane of the second elongated surface of the gauging element and a second elongated surface parallel to the first and spaced therefrom a distance less than the diameter of the rotary cutting element, there being transverse surfaces connecting the first and second elongated surfaces of said guide means so that a guide is provided to control the depth of cut as the rotary cutting element is inserted into the open slot end.

* * * * *